US008351811B2

(12) United States Patent
Ishio et al.

(10) Patent No.: US 8,351,811 B2
(45) Date of Patent: Jan. 8, 2013

(54) IMAGE FORMING APPARATUS WITH LOCKING STORAGE FOR OUTPUT IMAGES

(75) Inventors: Hisaya Ishio, Saitama (JP); Keiichiro Takahashi, Saitama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 395 days.

(21) Appl. No.: 12/713,044

(22) Filed: Feb. 25, 2010

(65) Prior Publication Data

US 2010/0221031 A1 Sep. 2, 2010

Related U.S. Application Data

(60) Provisional application No. 61/156,355, filed on Feb. 27, 2009, provisional application No. 61/156,369, filed on Feb. 27, 2009, provisional application No. 61/158,996, filed on Mar. 10, 2009.

(51) Int. Cl.
*G03G 15/00* (2006.01)

(52) U.S. Cl. ..... 399/80; 399/366; 399/405

(58) Field of Classification Search ..... 399/80, 399/366, 405

See application file for complete search history.

(56) References Cited

U.S. PATENT DOCUMENTS

| | | | | |
|---|---|---|---|---|
| 5,452,058 | A * | 9/1995 | Umeda | 399/366 |
| 6,375,742 | B2 | 4/2002 | Sano et al. | |
| 6,421,582 | B1 * | 7/2002 | Wada | 399/80 |
| 6,768,877 | B2 * | 7/2004 | Alegria et al. | 399/80 |
| 7,764,922 | B2 * | 7/2010 | Sasama | 399/405 |
| 8,086,164 | B2 * | 12/2011 | Koshida | 399/366 |
| 2008/0193182 | A1 * | 8/2008 | Sasama | 399/405 |
| 2009/0154970 | A1 | 6/2009 | Yoshida | |
| 2009/0251744 | A1 | 10/2009 | Tokutsu | |

FOREIGN PATENT DOCUMENTS

| | | | |
|---|---|---|---|
| JP | 2000-10442 | A | 1/2000 |
| JP | 3278626 | B2 | 2/2002 |
| JP | 2003-137470 | A | 5/2003 |
| JP | 2006-284612 | A | 10/2006 |
| JP | 2007-119173 | A | 5/2007 |
| JP | 2007-272858 | A | 10/2007 |

OTHER PUBLICATIONS

U.S. Appl. No. 12/576,077, Ishio.
U.S. Appl. No. 12/576,143, Ishio.

* cited by examiner

*Primary Examiner* — William J Royer
(74) *Attorney, Agent, or Firm* — Patterson & Sheridan, LLP

(57) ABSTRACT

An image forming apparatus includes, an image forming unit configured to fix a developer image on a sheet medium and to output the sheet medium, and an output-image storing unit configured to store, on the inner side of a door involving a lock mechanism, the sheet medium on which the developer image is fixed by the image forming unit.

16 Claims, 8 Drawing Sheets

IMAGE FORMING APPARATUS WITH LOCKING STORAGE FOR OUTPUT IMAGES

CROSS-REFERENCE TO RELATED APPLICATION

This application is based upon and claims the benefit of priority from: U.S. Provisional Applications No. 61/156,355 and No. 61/156,369 both filed on Feb. 27, 2009, and No. 61/158,996 filed on Mar. 10, 2009, the entire contents of each of which are incorporated herein by reference.

TECHNICAL FIELD

This invention relates to an image forming apparatus that includes locking storage for output images, and may be multi-arrangeable and multifunction.

BACKGROUND

An image forming apparatus called an MFP (Multi-Functional Peripheral) such as a color copying machine, a printer, or a facsimile apparatus often includes an image forming unit (i.e., a printer section), an image reading unit (i.e., a scanner section), a control unit, a storage unit (i.e., a hard disk drive), and an operation unit (i.e., a control panel).

In recent years, in order to effectively utilize a space required for setting the MFP, an intra-body paper discharge system for locating a stock unit, which stores sheets (outputs) as image outputs, between a printer and a scanner in the height direction is widely adopted. An apparatus incorporating finishing apparatuses such as a stapler that staples sheets (outputs) as image outputs and a sorter that sorts sheets (outputs) as image outputs in a unit of the number of copies or a unit of pages is also already widely used.

It goes without saying that an arbitrary PC (Personal Computer) located on a network with respect to plural MFPs connected to the network can instruct a specific MFP to perform image reading (scanning) and image output (print-out).

However, in an ADF (Automatic Document Feeder) integrally included in a scanner unit, a document insertion port is provided on one side of a document feeding unit and paper conveying rollers are provided in upper and lower portions in the document insertion port to nip an original document and send the original document to a reading unit. Therefore, a document placing surface of a document tray is attached below a paper nipping position of the rollers. Therefore, a step is formed between the upper surface of a feeding device and the document tray. Since the document insertion port, the document tray, and a paper discharge tray are exposed, in some case cases, dust is photographed in a read image or the dust adhere adheres to an original document after reading because of intrusion of the dust into a mechanical unit.

Finishing apparatuses (for example, sorting, stapling, punching, saddle stapling, and interleaving paper insertion) can be arbitrarily combined on the basis of a request of a user. However, a requested finishing apparatus is designed to be separately mounted on a paper discharge side for storing sheets (outputs) as image outputs of the MFP. Therefore, since respective units of the finishing apparatuses are given different shapes for respective applications (functions), in some cases, uniformity of an external design is spoiled when the finishing apparatuses are mounted. Since the units are arranged to be interposed in respective paths, if functions are increased, a housing size inevitably increases.

In recent years, there is increasing interest in security for documents (image outputs). An increasing number of MFPs adopt means for preventing documents from being taken away by adding a private print function (images can be output only when authentication is successful). However, a user needs to wait near an MFP until image output is completed. When a large number of images are output, convenience of use of the MFP is low. A structure for closing a paper discharge unit (a storing unit for image outputs) with a door or the like is also put to practical use. However, in particular, when a door or the like is prepared in an MFP of the intra-body paper discharge type, when a user takes out a discharged sheet, the user cannot take out the sheet unless the user stretches the arm to the depth (because the sheet is present in a body of the MFP). There is still room for improvement in terms of operability (workability). The door provided in the MFP is effective for preventing the sheets (outputs) as the image outputs from being taken away or output information from being viewed (grasped). However, when a sheet jam or the like occurs, all functions are suspended until a user who instructs image output involving the lock of the door arrives (near the apparatus).

As an ADF in which a document tray automatically closes to cover a document table or a document insertion port, JP-A-2007-119173 (Document 1) is known.

However, although the ADF disclosed in Document 1 has a structure in which the document tray can be displaced like a cover with respect to the document table, an armor cover or the like cannot be formed flat (a step between the upper surface of a feeding device and the document tray cannot be eliminated).

As a sheet finishing apparatus in which a finisher(s) as a finishing apparatus(es) (for sorting and/or stapling) can be incorporated in a space, which is prepared in advance, on the basis of a request of a user and an image forming apparatus in which the sheet finishing apparatus is incorporated, JP-A-2003-137470 (Document 2) is known.

However, in Document 2, the space secured for intra-body paper discharge is replaced with the finishing apparatus(es). This means that, although the size of the entire apparatus does not change, the space for intra-body paper discharge is reduced. Therefore, in the MFP of the intra-body paper discharge type, there is still room for improvement concerning operability (workability) for taking out a discharged sheet.

As a security system that adds authentication information for specifying a user terminal to print data for printing and acquires the authentication information from the user terminal carried by a user to release the lock of a printing function (enable printing), JP-A-2007-272858 (Document 3) is known.

However, the security system disclosed in Document 3 enables printing after the user carrying the user terminal moves to near a printing apparatus. The user is still requested to wait near the printing apparatus until image output (printing) is completed.

In order to prevent outsiders from taking away sheets (outputs) as image outputs or preventing outsiders from viewing output information (grasping the output information), it is effective to provide a door in a storing unit configured to store the sheets (outputs) as image outputs. However, when a sheet jam or the like occurs, all functions are suspended until a user who instructs image output involving the lock of the door arrives (near the apparatus). This is evident from JP-A-2000-10442 (Document 4).

Because of such a background, the development team including the inventor of this application still continues the development at present following U.S. application Ser. Nos. 12/576,077 and 12/576,143 (both filed Aug. 8, 2008).

SUMMARY

It is an object of the present invention to provide, on the basis of desires of users, an image forming apparatus that is multi-arrangeable and multifunction.

It is another object of the present invention to provide an image forming apparatus that is multi-arrangeable and an external shape and a size of which do not change even when option units and the like are incorporated to make it possible to realize all functions desired by users.

It is still another object of the present invention to provide an image forming apparatus that is multi-arrangeable and from which image outputs (outputs) can be easily taken out (not restricted at the time of taking out) even when option units and the like are incorporated to make it possible to realize all functions desired by users.

According to an aspect of the invention, there is provided an image forming apparatus comprising: an image forming unit which fixes a developer image on a sheet medium and outputs the sheet medium; and an output-image storing unit which stores, on an inner side of a door involving a lock mechanism, the sheet medium on which the developer image is fixed by the image forming unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An example of an embodiment of the present invention is explained in detail below with reference to the accompanying drawings.

Figure 10:
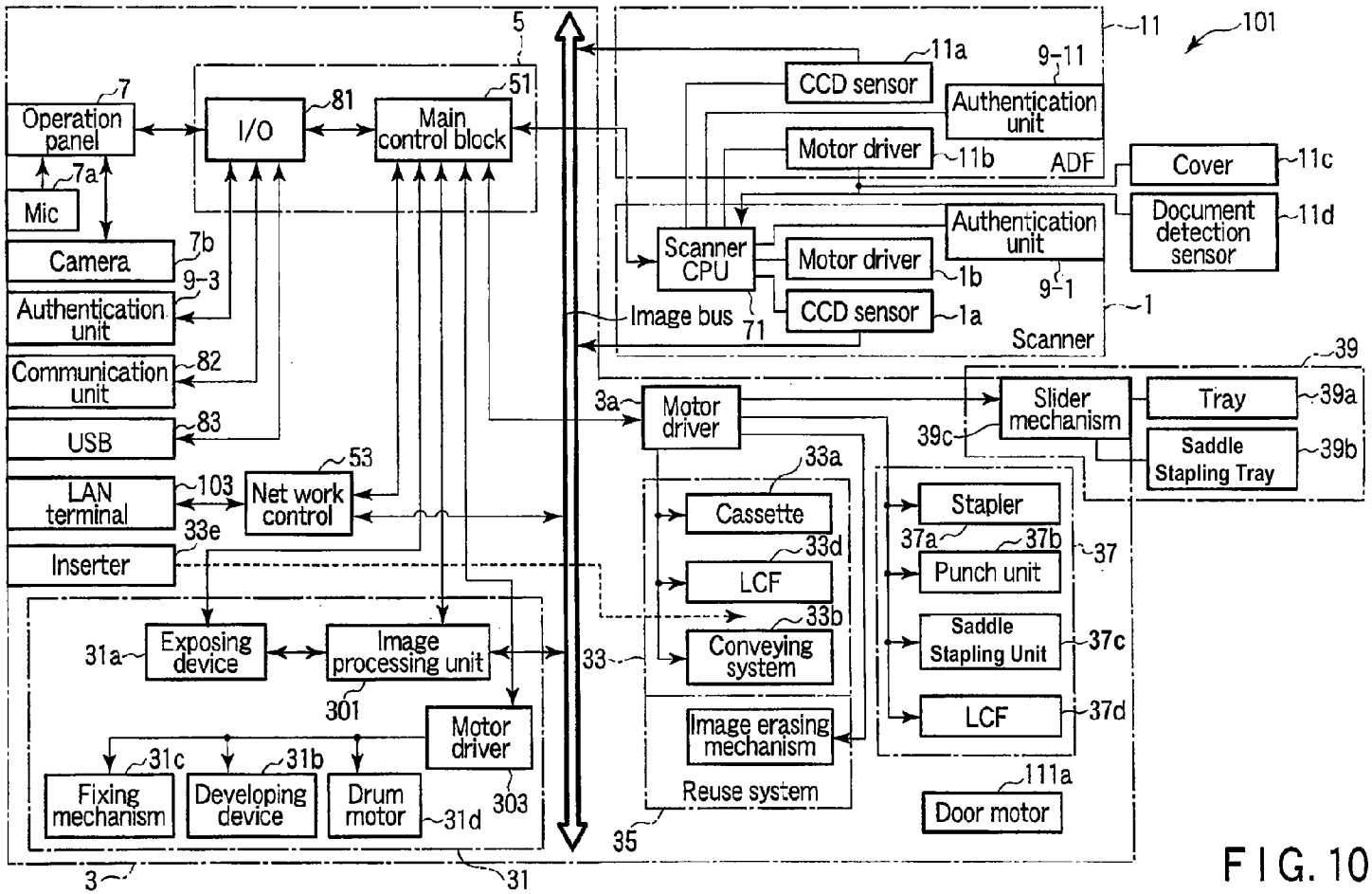
FIG. 10 is a diagram of a control system (a control block) for the MFP shown in FIGS. 1A to 1F, 2, 3A, 3B, 4A to 4C, and 5 to 9.

FIGS. 1A to 1F, 2, 3A, 3B, and 10 are schematic diagrams of an image forming apparatus (a multi-functional peripheral (MFP)) 101 to which the present invention can be applied. FIG. 10 is a diagram of an example of a control system for the image forming apparatus 101.

The image forming apparatus 101 forms an image on a sheet medium called sheet with "toner" or "ink" and outputs the image as an "image output".

Figure 6:
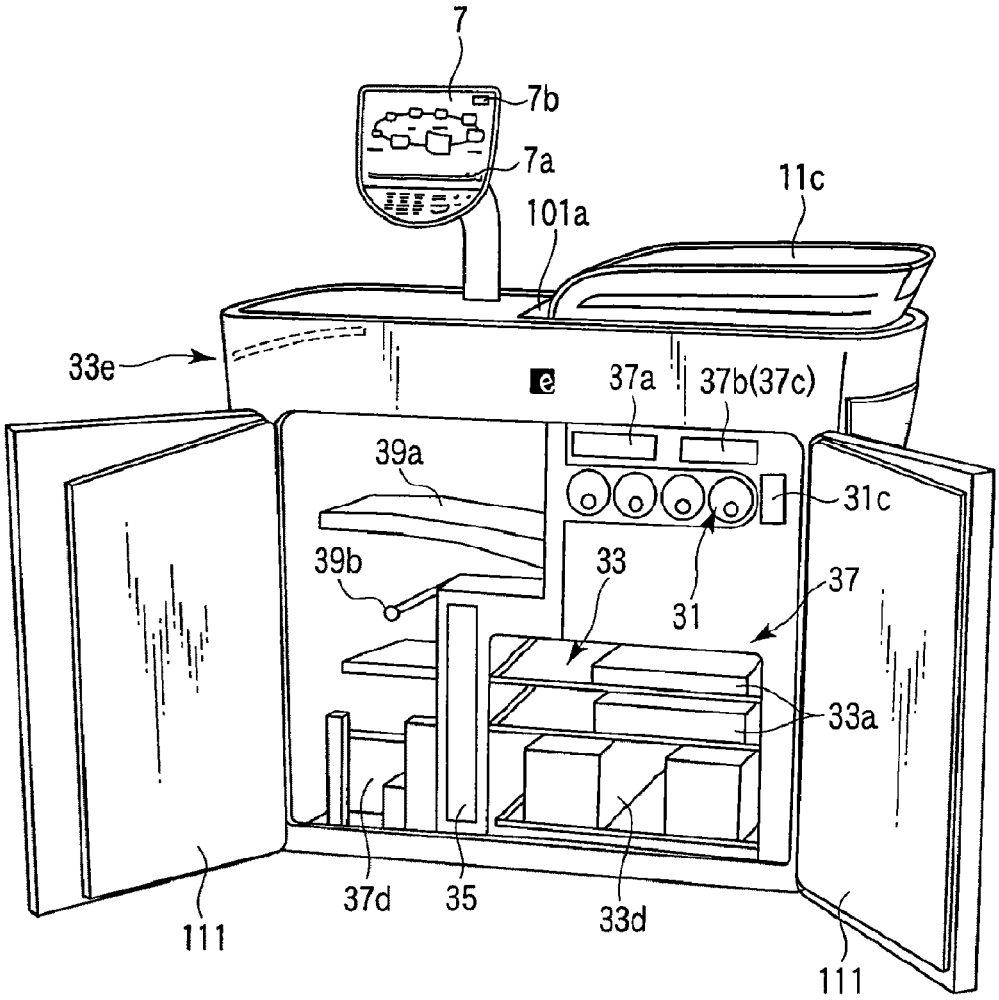
FIG. 6 is a diagram of a state in which the door is opened in the perspective view of the external appearance of the MFP shown in FIGS. 1A to 1F.

The image forming apparatus 101 includes at least a scanner (an image reading unit) 1 configured to acquire image information as contrast of light, an image forming unit 3 configured to form an "image" corresponding to image data supplied from the scanner 1 or the outside and outputs the image as an "image output", a control unit 5 configured to instruct the scanner 1 and the image forming unit 3 about, for example, image formation and accumulation of image data and execute user authentication and lock of a door (security securing) on the basis of a request of a user, and an operation panel 7 configured to instruct the control unit 5 about image formation by the image forming unit 3 and used for user authentication. The image forming apparatus 101 has, at least in the front surface of the apparatus, a door 111 that is opened only when the user authentication is successful or during service. As shown in FIG. 6 as an example, the door 111 may be opened to both the left and right on the front side of the image forming apparatus 101. However, although not shown in the figure, the door 111 may slide in the left to right direction of the image forming apparatus 101. Alternatively, in a state shown in FIG. 6, left and right doors 111 may be folded.

The image forming unit 3 includes an image forming mechanism 31 configured to form a color image according to a subtractive process (subtractive color mixture), a sheet storing mechanism 33 configured to store sheets (sheet materials) of various sizes, an image erasing mechanism, i.e., reuse system 35 configured to store a sheet on which an image is already formed, erase the image for reuse of the sheet, and provide the sheet to the sheet storing mechanism 33, an extending (finishing) mechanism 37 configured to enable mounting and operation of finishing apparatuses such as a stapler 37*a*, a punch unit 37*b*, and a saddle stapling unit 37*c* that are arbitrarily combined on the basis of a desire of a user, and a storing mechanism 39 configured to prevent removal of the image output and acquisition of information of the image output by an outsider and store an "image output" output by the image forming mechanism 31.

As the basic configuration of the extending (finishing) mechanism (a finishing unit) 37, only a moving tray (a storing tray) is prepared. The stapler 37*a*, the punch unit 37*b*, the saddle stapling unit 37*c*, and the like are options prepared according to a desire of the user. The extending (finishing) mechanism 37 may include an LCF (Large Capacity Cassette) 37*d* that can store sheets of the same size ten times as many as those stored by a sheet cassette. Places where units included in the extending mechanism 37 are mounted in the image forming apparatus 101 are determined. Therefore, irrespectively of how functions are extended, there is little influence on an external appearance of the image forming apparatus 101. Unlike the past, a setting space for the image forming apparatus 101 is not increased or an external shape of the image forming apparatus 101 does not change. Even when the external shape is changed, since there is little influence on an internal mechanism, it is easy to send a different design image to the market in a model change or model expansion.

The image forming mechanism 31 forms an output image on a sheet according to an image forming process of a widely-known electrostatic system or an ink jet type and supplies the output image to the storing mechanism 39 as an "image output". Although not explained in detail, in the case of the electrostatic system, the image forming mechanism 31 obtains an "output image" according to a subtractive process by exposing a photoconductive member which is not explained in detail, driven by a drum motor 31*d* controlled by a motor driver 303, to form latent images with an exposing device 31*a* (as long as the exposing device 31*a* can cope with data for four colors "C (Cyan)", "M (Magenta)", "Y (Yellow)", and "BK (Black)", a type such as an integral type or a four-color type is arbitrary) according to image data dissolved into the colors "C", "M", and "Y" and visualizing the latent images and superimposing visualized images on a sheet with a developing device 31*b* (as long as the developing device 31*b* can cope with data for the four colors "C", "M", "Y", and "BK", a type such as an integral type or a four-color type is arbitrary) in which toners having corresponding colors are stored. It goes without saying that a "BK" toner is used in order to output, for example, an area (a pixel) in which all of "C", "M", and "Y" overlap and character data or the like that is determined to be output in a single color of black in advance. In the case of the ink jet type, the image forming mechanism 31 forms an "image output" on a sheet by directly supplying the inks of "C", "M", "Y", and "BK".

The sheet storing mechanism 33 includes at least one sheet cassette 33*a*, a sheet conveying path (a conveying system) 33*b* leading from the sheet cassette 33*a* to the image forming mechanism 31, and a bypass conveying path 33*c* that is provided halfway in the sheet conveying path 33*b* and can feed a sheet (a sheet medium) to the sheet conveying path 33*b* independently from a sheet from the sheet cassette 33*a*. The bypass conveying path 33*c* is useful for feeding a special sheet having thickness equal to or larger than fixed thickness and a transparent resin sheet or the like for an overhead projector to the image forming mechanism 31. It is also possible to set an LCF (Large Capacity Cassette) 33*d* that can store sheets of the same size ten times as many as those stored in the sheet cassette 33*a*. As explained above, in some cases, the LCF is set in a predetermined position of the extending (finishing) mechanism 37 explained below. Each of the sheet cassette 33*a*, the sheet conveying path (a conveying system) 33*b*, and the LCF 33*d* includes a motor which is not explained in detail, controlled by a motor driver 3*a*.

The image erasing mechanism 35 includes at least a storing unit (a tray) configured to store a sheet, on at least one side of which an image is already formed, an image erasing unit configured to heat the sheet stored by the storing unit (the tray) and erase the image, and a reuse conveying path configured to feed the sheet, from which the image is erased, to a predetermined conveying path of the sheet storing mechanism 33. The reuse conveying path configured to feed the sheet includes a motor which is not explained in detail, controlled by the motor driver 3*a*.

When the image on the sheet is formed of a toner having a characteristic disclosed in U.S. Ser. No. 09/235,477 (U.S. Pat. No. 6,375,742 B2), the sheet is caused to pass through a thermostatic unit, which is maintained at a fixed temperature, for example, 150° C., for a fixed time, for example, one minute, whereby colors peculiar to toner images fade and the image is substantially erased. Since the toners contain resin components, prior to heating by the thermostatic unit, it is desirable to scrape off a part of the image (the toner images) before erasing. By scraping off a part of the image before erasing, it is possible to suppress a difference between the reflectance of a remaining portion of the resin components of the discolored toners and the reflectance of the sheet (the entire sheet or the peripheral portion of the sheet). For scraping off a part of the image (the toner images) before erasing, it is possible to apply JP-A-2006-284612 (Japanese Patent Application No. 2005-100308) filed earlier by the same assignee or Japanese Patent No. 3278626 filed earlier by the same assignee.

When the image on the sheet is formed of ink, it is possible to apply U.S. application Ser. No. 12/330,972 (filed Dec. 9, 2008) filed earlier by the same assignee.

The extending (finishing) mechanism 37 includes the stapler 37*a* configured to staple an arbitrary number of image outputs (sheet media). When designated from the operation panel 7 or an external PC in advance, the extending (finishing) mechanism 37 staples output sheet media. According to a request of the user, a finisher mechanism may be incorporated that operates in a group mode for storing, when plural same pages are output, the pages one by one and a sort mode for storing an arbitrary number of outputs (copies) in copy units and stores an image output. The punch unit 37*b* is useful for opening an arbitrary number of holes, which can be used for filing of an image output, in predetermined positions. The extending (finishing) mechanism 37 includes the saddle stapling unit 37*c* configured to stitch (to staple) the center of sheets for simple bookbinding called saddle stitching 37*c* configured to staple an arbitrary number of image outputs (sheet media). When designated from the operation panel 7 or an external PC in advance, the extending (finishing) mechanism 37 staples (saddle-staples) output sheet media. Each of the stapler 37*a*, the punch unit 37*b*, and the saddle stapling unit 37*c* includes a motor which is not explained in detail, controlled and driven by the motor driver 3*a*. As explained above, in some cases, the LCF 37*d* is set in a predetermined position of the extending (finishing) mechanism 37, the LCF 37*d* includes a motor which is not explained in detail, controlled and driven by the motor driver 3*a*.

Places where the finishing units (the stapler 37*a*, the punch unit 37*b*, the saddle stapling unit 37*c*, and the like) included in the extending mechanism 37 are incorporated in a housing of the image forming apparatus 101 are set in advance. Function extension is easy in an arbitrary combination of the finishing units by mounting arbitrary units in predetermined places according to necessity. For example, an external design does not change according to presence or absence of the punch unit 37*b*. The punch unit 37*b*, the stapler 37*a*, and the saddle stapling unit 37*c* are arranged at fixed or more intervals from a fixing mechanism 31*c* in advance. The punch unit 37*b*, the stapler 37*a*, and the saddle staple unit 37*c* are mounted between the storing mechanism (a storing tray) 39 explained below and the fixing mechanism 31*c*. Consequently, it is possible to realize an arbitrary combination of the finishing units that makes it possible to easily perform function extension.

The storing mechanism 39 includes an image output storing tray (output-image storing unit) 39*a* configured to store, in order, sheets on which the toners are fixed by the fixing mechanism 31*c* and specified to be movable by a predetermined distance in a direction orthogonal to a direction in which the sheets are conveyed and to the front side of the image forming apparatus 101 at a point when conveyance of a set number of image outputs ends. When predetermined finishing designated by the user in advance is executed, after the finishing, a conveyed (discharged) sheet is guided to a position different from the image output storing tray 39*a*, for example, a saddle stapling tray 39*b* prepared below the image output storing tray 39*a*. Each of the image output storing tray 39*a* and the saddle staple tray 39*b* of the storing mechanism 39 is slid to the front side of the image forming apparatus 101 by a slide mechanism (a motor and link mechanism) 39*c* includes at least one of a motor and link mechanism which is not explained in detail, controlled and driven by the motor driver 3*a*, explained with reference to FIG. 10 when the user approaches the image forming apparatus 101 to carry back an image output or authentication by, for example, a (portable) authenticating mechanism carried by the user or an identifier personally carried by the user for authentication of the user such as an ID card ends. At the same time, the cover (a security mechanism) that covers the image forming apparatus 101 is opened.

Figure 7:
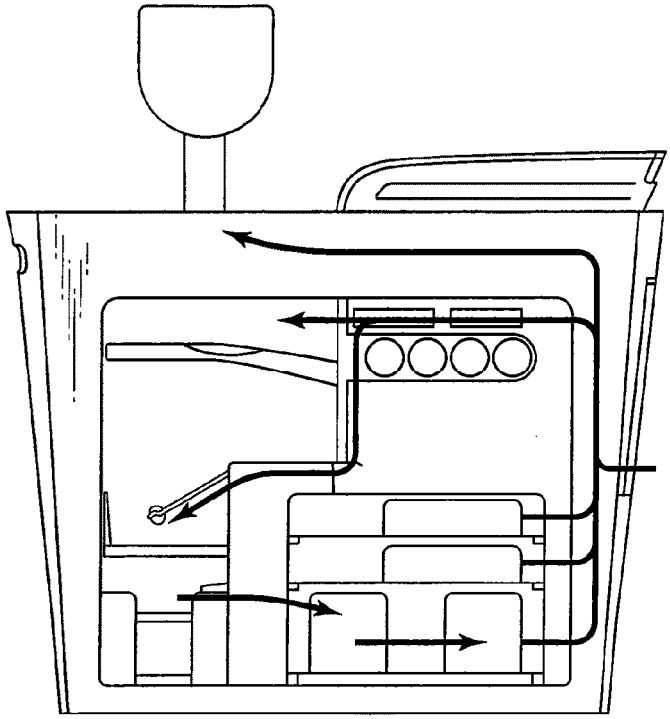
FIG. 7 is a diagram for explaining a characteristic of a flow of a sheet (a conveying system) in the MFP shown in FIGS. 1A to 1F.
Figure 8:
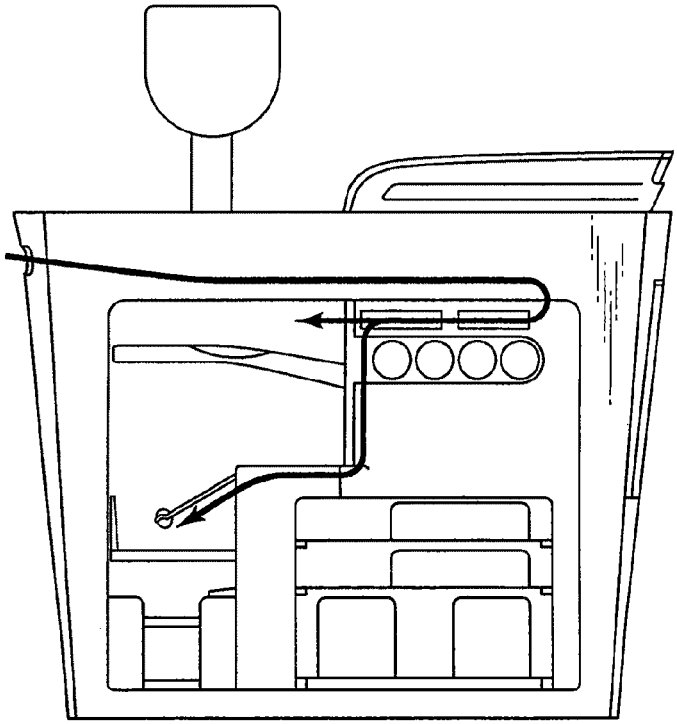
FIG. 8 is a diagram for explaining a characteristic of a flow of a sheet (the conveying system) from an inserter in the MFP shown in FIGS. 1A to 1F.

Since the paper discharge path is divided into two, as schematically shown in FIG. 7, it is possible to clearly distinguish paper discharge for an image output not requiring finishing (to a main tray (a top open tray of the opened image forming apparatus 101) 101*a* near an ADF (Automatic Document Feeder) 11 on the outside of the image forming apparatus 101 different from the storing mechanism 39) from paper discharge for an image output requiring finishing by the extending (finishing) mechanism 37. The image output not requiring finishing is discharged to the open tray 101*a* and copied on the site or used for an image output (print or the like via a network) not requiring treatment as a confidential document or the like. This makes it possible to easily take out a discharged sheet without limiting treatment of an image output more than necessary. An image output to be finished by the extending (finishing) mechanism 37 is discharged to the image output storing tray 39*a* or the saddle stapling tray 39*b* provided in the storing mechanism 39 in the housing of the image forming apparatus 101 and the front of the image forming apparatus 101 is covered by the door 111 having a lock mechanism to prevent an original document from being exposed and taken away. Consequently, both convenience of use and security securing are realized.

As explained above, the space below the image output storing tray 39*a* of the storing mechanism 39 is formed as the space in which the paper feeding device (LCF) 37*d*, which can stock sheets, can be mounted. When sheets stored in the sheet cassette 33*a* are exhausted, sheets can be supplied (added) to the sheet cassette 33*a*. Since the image erasing mechanism 35 is incorporated, a sheet on which an image is formed by using an erasable toner or ink can also be reused through the sheet cassette 33*a*.

Since the front (of the image forming apparatus 101) is covered by the door 111 having the lock mechanism, it is possible to prevent a document "(image output)" from being exposed and taken away and realize both convenience of use and security securing. When a sheet is taken out in removal processing (jam processing) performed when the sheet jams in the image forming apparatus 101, maintenance, or the like, it is possible to finish personal authentication according to an unlock instruction explained below and unlock the door 111 to open the door 111 with a door motor (not shown) and a link mechanism which is not explained in detail, controlled and driven by the motor driver 3*a*. The image output storing tray 39*a*, the sheet cassette 33*a*, and the like or the incorporated units of the finishing apparatus such as the stapler 37*a*, the punch unit 37*b*, and the saddle stapling unit 37*c* can be moved to the front of the image forming apparatus 101 by a manual drawing-out mechanism (a slider) or the like (not explained in detail).

Specifically, a document (an image output) output to the image output storing tray 39*a* in the image output storing mechanism 39 is protected by the door 111. Therefore, even if image data sent from a PC (personal computer) on a desk of a user who requests an image output is left as output, there is no risk that the image data is taken away by an outsider or content of the image data (information of the image output) is viewed by an outsider. Unlike the private printing in the past, there is no inconvenience that the user has to start output after being authenticated by an apparatus and wait until printing ends.

Figure 9:
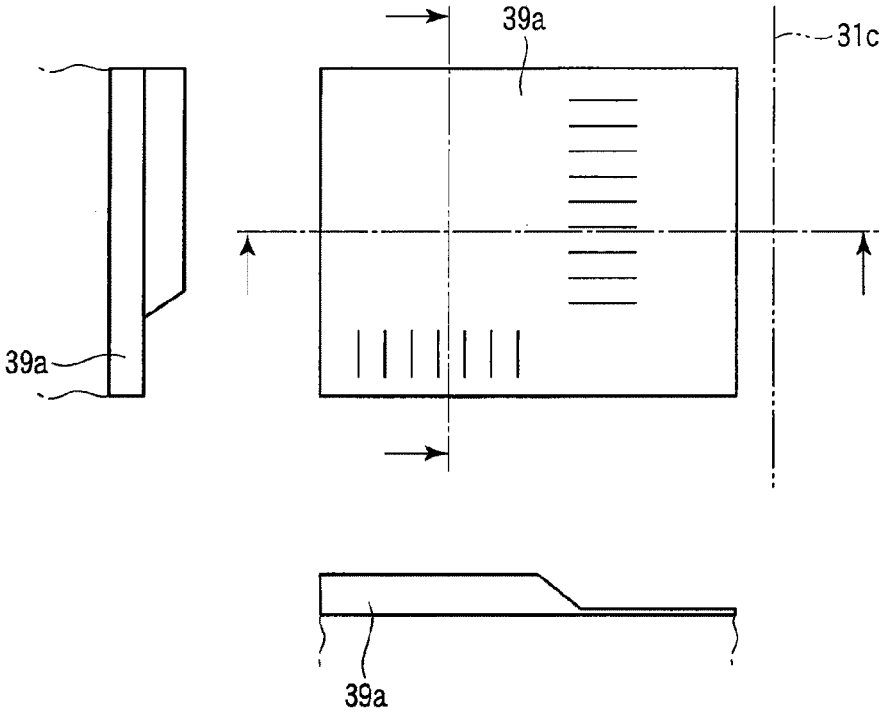
FIG. 9 is a diagram for explaining a characteristic of a storing mechanism (paper discharge and image output) of the MFP shown in FIGS. 1A to 1F.

The image output to the storing mechanism 39 is moved to the image output storing tray 39*a* after all image outputs are completed. When personal authentication for the user is finished, the image output storing tray 39*a* slides to the user side (the front) of the image forming apparatus 101 in association with the opening of the door 111. The user can easily take out a printed sheet "(image output)" without inserting a hand into the inner side in the body of the storing mechanism 39. As schematically shown in FIG. 9, an area away from the fixing mechanism 31*c* by a fixed distance is formed in a convex shape compared with the vicinity of the fixing mechanism 31*c* such that, when an image output from the fixing mechanism 31*c* is taken out, the hand of the user can be easily placed between the image output and the image output storing tray 39*a*. The area formed in the convex shape also has a space with respect to a side orthogonal to a side adjacent to the fixing mechanism 31*c*, i.e., the front side of the image forming apparatus 101 such that the hand of the user can be easily placed between the image output and the image output storing tray 39*a*.

The unlock instruction is performed by personal authentication using authentication systems of various types that use, for example, voice (voice print) of the user acquired by using a microphone 7*a* incorporated in the operation panel 7 connected to the image forming unit 3, face authentication performed by a camera 7*b* incorporated in the operation panel 7 using characteristics of a face of the user, authentication by code input or communication with an ID card by at least one of an authentication unit 9-11 incorporated in the ADF 11 provided in, an authentication unit 9-3 incorporated in an outer panel of the image forming unit 3, an authentication unit 9-1 incorporated in a predetermined position of the scanner 1, or a predetermined position of the operation panel 7 or integrally with a scanner, for example, and a biometrics authentication system provided in, for example, a predetermined position of the armor panel of the image forming unit 3 to be capable of detecting a not-shown fingerprint, vein pattern, or the like. Authentication of a non-contact type with, for example, a portable terminal or a radio ID card carried by the user can also be performed by, for example, radio communication using a communication unit. In the radio communication (the non-contact type), for example, the Bluetooth standard can also be used.

The image output storing tray 39*a* in the storing mechanism 39 can include plural trays and may also be used as a sheet type sorting function, a mail box function, and the like.

Specifically, when personal authentication explained later is finished, the door 111 in the front of the image forming apparatus 101 is automatically opened and the image output storing tray 39*a* (or the saddle stapling tray 39*b*) slides forward in association with the opening of the door 111. The user can easily take out an image output (a printed sheet) without inserting a hand to the depth in the body.

It goes without saying that, when it is unnecessary to protect a document, it is also possible to remove the door 111 and open the entire storing mechanism 39. Even in this case, it is desirable to slide the image output storing tray 39*a* to the front of the image forming apparatus 101 using the slider mechanism 39*c*.

As explained below with reference to FIGS. 4A to 4C and 5, the scanner 1 includes a document feeding mechanism that can simultaneously read both sides of an original document. A second CCD sensor 11*a* provided in the ADF 11 to be capable of performing reading independently from the scanner 1 reads information on one side of the original document.

Figure 5:
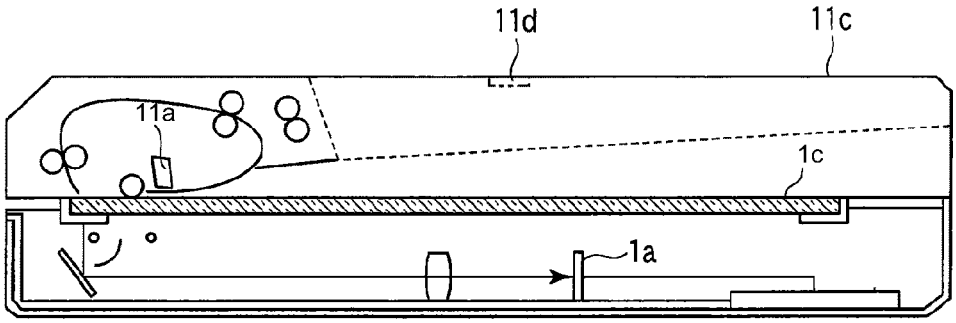
FIG. 5 is a diagram of a positional relation between two image reading sensors included in the ADF explained with reference to FIGS. 4A to 4C.

As explained below with reference to FIG. 5, the scanner 1 also includes a platen glass (an image reading surface) 1*c*. The authentication unit 9 (i.e., 9-1 and/or 9-11) for personal authentication may be provided in the scanner 1 or may be provided in the ADF 11. It goes without saying that the authentication unit 9 (i.e., 9-1 and/or 9-11) can also be provided in both the scanner 1 and the ADF 11. The scanner 1 includes a motor configured to move a mirror and lamp driven by a motor driver 1*b* and controlled with a scanner CPU 71 and to make an image signal correspond to the image information of a document (a readable object).

Figures 1A, 1B, 1C, 1D, 1E, 1F:
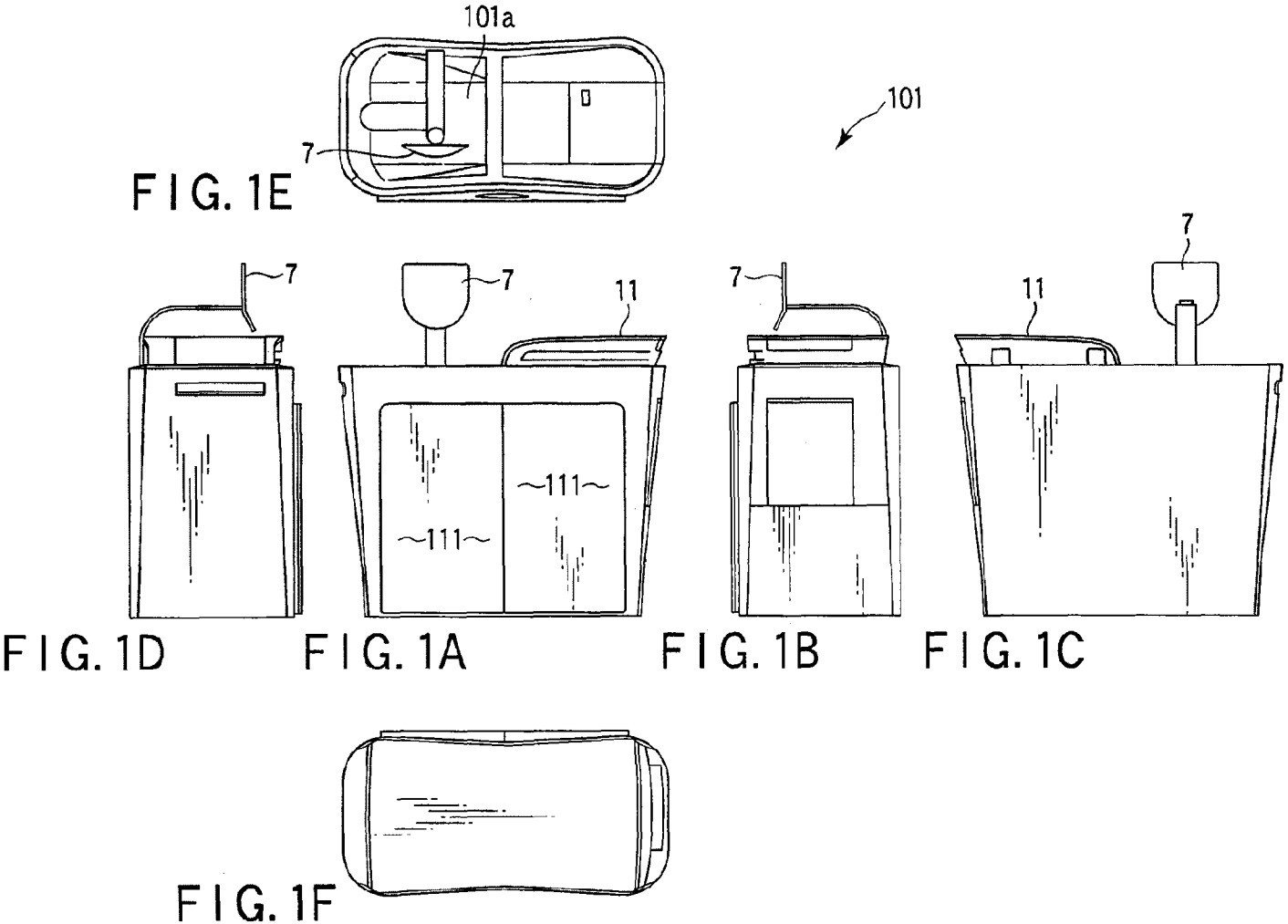
FIG. 1A is a diagram of a state of an external appearance of an image forming apparatus (a multi-functional peripheral (MFP)) according to an embodiment of the present invention viewed from the front.
FIG. 1B is a diagram of a state of the external appearance of the image forming apparatus (the multi-functional peripheral (MFP)) according to the embodiment viewed from the right.
FIG. 1C is a diagram of a state of the external appearance of the image forming apparatus (the multi-functional peripheral (MFP)) according to the embodiment viewed from the back.
FIG. 1D is a diagram of a state of the external appearance of the image forming apparatus (the multi-functional peripheral (MFP)) according to the embodiment viewed from the left.
FIG. 1E is a diagram of a state of the external appearance of the image forming apparatus (the multi-functional peripheral (MFP)) according to the embodiment viewed from above.
FIG. 1F is a diagram of a state of the external appearance of the image forming apparatus (the multi-functional peripheral (MFP)) according to the embodiment viewed from the bottom.
Figure 2:
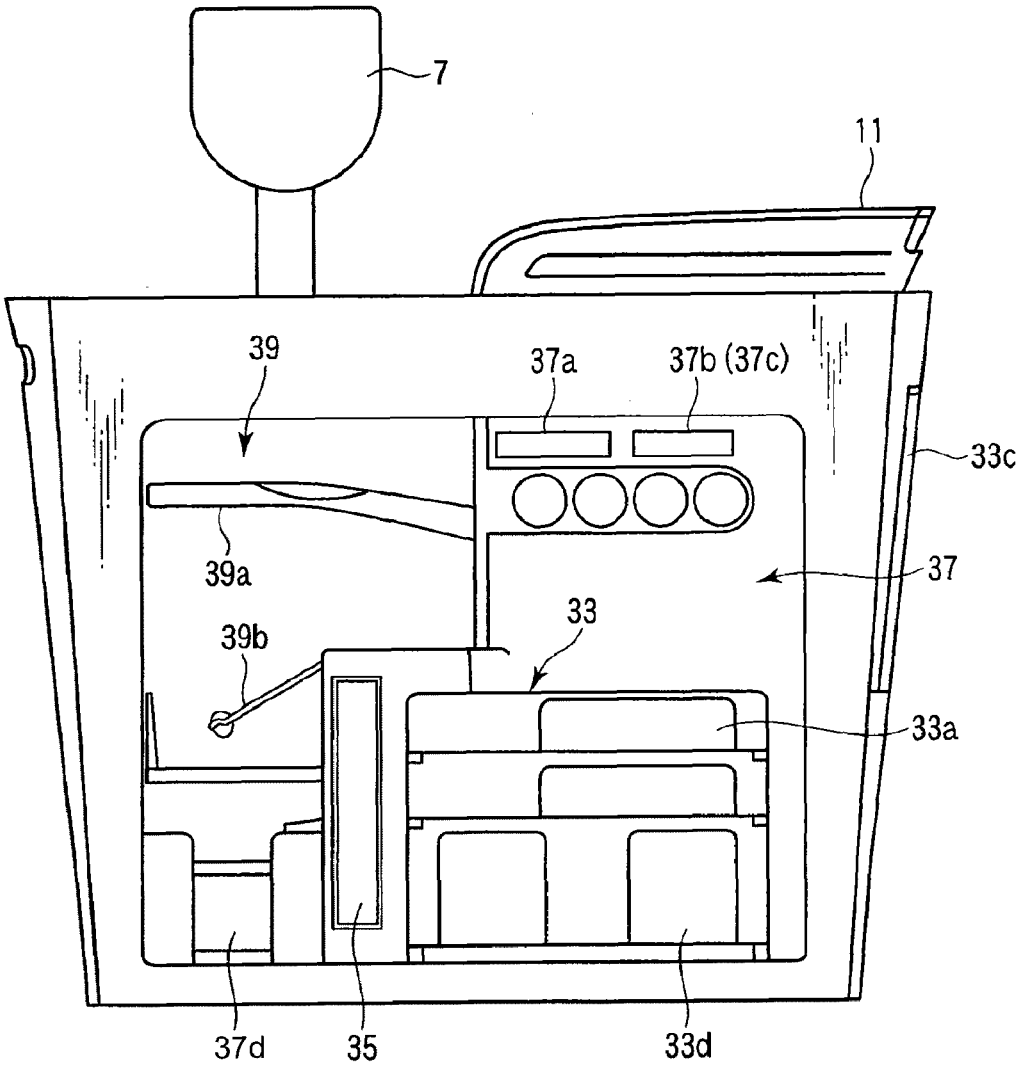
FIG. 2 is a diagram of a state in which a door in a front surface is removed from the MFP shown in FIGS. 1A to 1F viewed from the front in FIG. 1A.
Figure 3A:
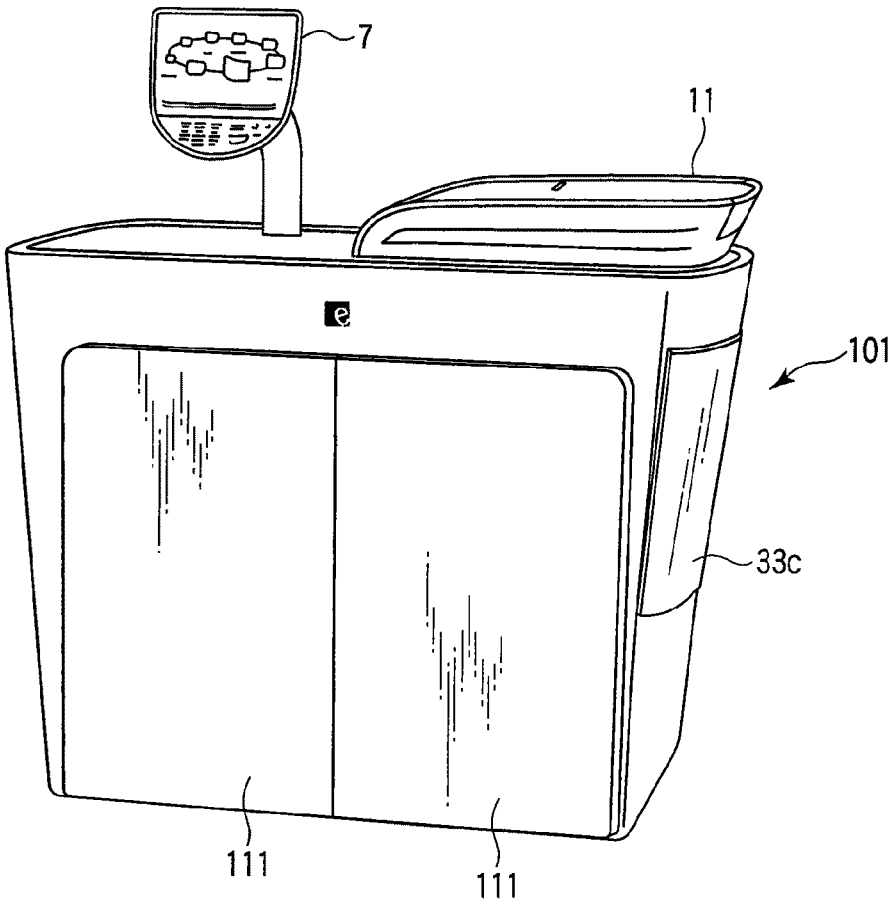
FIG. 3A is a perspective view of the external appearance of the MFP shown in FIGS. 1A to 1F.
Figure 3B:
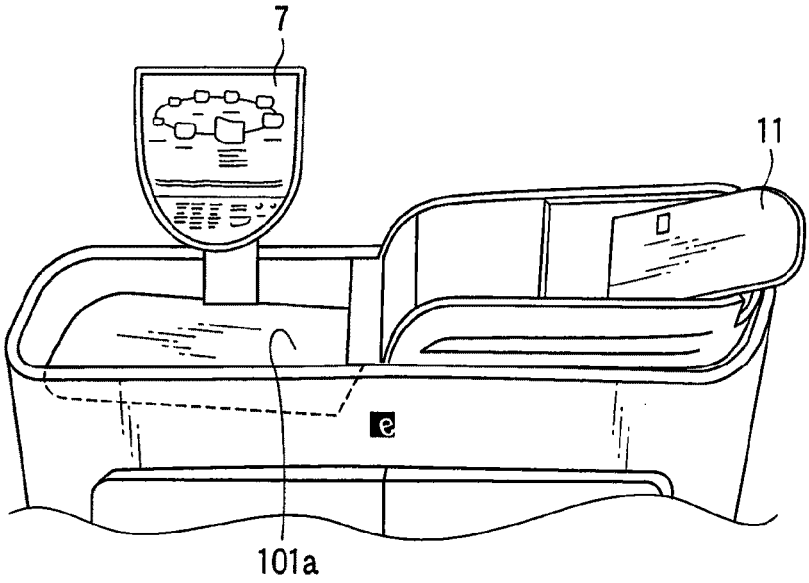
FIG. 3B is a diagram of the external appearance of the MFP shown in FIG. 3A from which a section near a main (open) tray is drawn out.
Figure 4A:
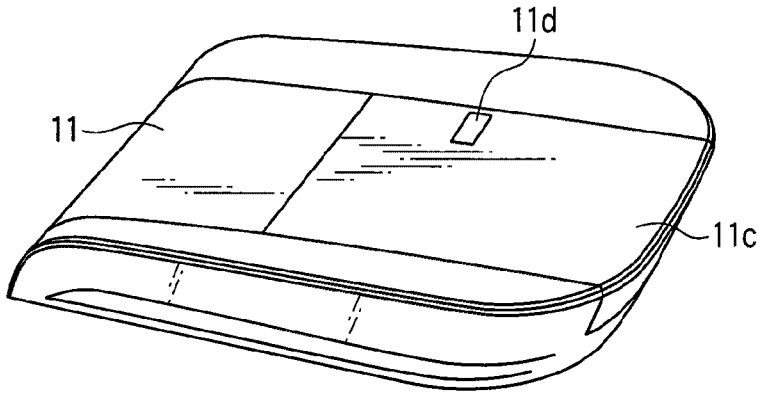
FIGS. 4A, 4B and 4C are respectively diagrams of moving states of a cover (an armor) during operation of an ADF used integrally with the MFP shown in FIGS. 1A to 1F.
Figure 4B:
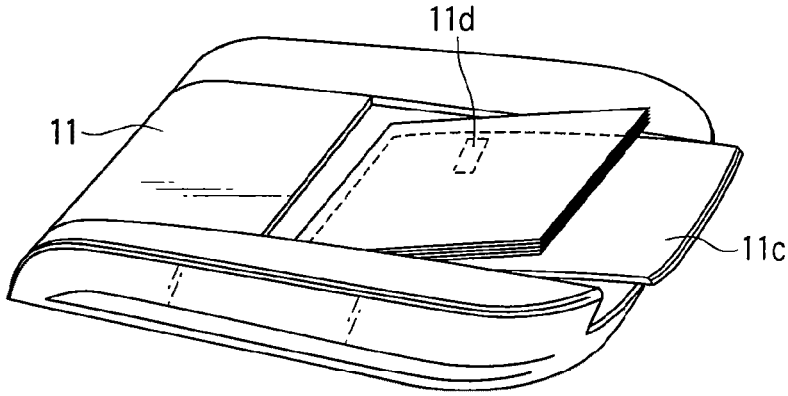
Figure 4C:
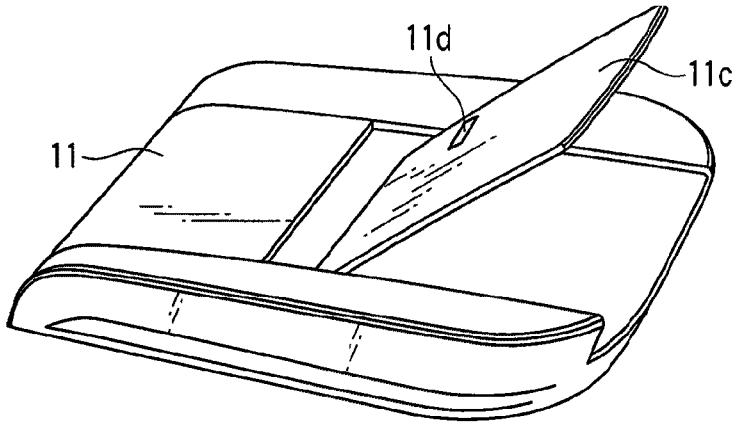

In the ADF 11, a top cover 11*c* is movable in order to prevent intrusion of dust and the like into the reading unit. When an original document is not read, the top cover 11*c* covers a document insertion port. When the user is about to set an original document on the top cover 11*c* to use the ADF 11, a document detection sensor 11*d* (an optical sensor, a weight sensor, and the like) detects the original document, the top cover 11*c* shifts to a state shown in FIG. 4B and the document conveying mechanism is exposed, and the tray (the top cover 11*c*) automatically moves to a reading position and shifts to a paper feed standby state with a motor and a link mechanism which are not explained in detail, controlled and driven by a motor driver 11*b*. When a sheet jams, as shown in FIG. 4C, the top cover 11*c* can be opened enough for making it easy for the user to insert a hand (the user can lift the tray (the top cover 11*c*) with the vicinity of the document insertion port as a fulcrum in a state of a tray position during document reading). In this case, the top cover 11*c* can be opened to an angle for not preventing removal of an original document after reading.

The ADF 11 includes a paper feeding mechanism configured to simultaneously read both sides of an original document. One side of the original document is read by a first CCD sensor 1*a* of the scanner 1 and the other side is read by the second CCD sensor 11*a* of the ADF 11. The document moved readable by the paper feeding mechanism includes a motor driven by the motor driver 11*b* and controlled with the scanner CPU 71 and to make an image signal corresponds to the image information of the other side of the document (a readable object). Therefore, an intermediate tray (a tray configured to temporarily put paper on standby when the original document is reversed or a path for the tray) widely used in reading information on the two side of the original document is not present. The ADF 11 can be simplified by using two document supporting units of the document tray (the top cover 11*c*) and the paper discharge tray (which can also be a part of a structure in the ADF 11).

Although not explained in detail, the control unit 5 includes a power supply unit (not shown) configured to convert electric power from the commercial power supply into a voltage and an electric current suitable for operation of the units of the image forming apparatus 101. The control unit 5 includes a main control block 51 configured to control operation of the image forming unit 3 according to a control command supplied from the operation panel 7 and the scanner 1 with the scanner CPU 71 configured to control operation of the scanner 1 and the ADF 11. The control unit 5 connected to an image processing unit 301 configured to supply image data, which is supplied from the scanner 1, to the image forming unit 3 and an I/O (input/output) control block 81 configured to control operation of the authentication unit 9-3, communication unit 82 and a USB (universal serial bus) 83. The main control block 51 has a function of a server. The main control block 51 can also perform, for example, image formation corresponding to image data transferred from a not-shown external apparatus connected via a LAN terminal 103 and a network control 53. The main control block 51 monitors, for example, abnormality of the operation panel 7, the scanner 1, or the image forming unit 3, residual quantities of sheet media stored in the image forming unit 3, a developer (toner), and staples of the stapler 37*a* of the extending mechanism 37.

The operation panel 7 is fixed to the image forming apparatus 101 by an arm or the like that can swing or turn on a side of the scanner 1 and in a range in which the arm or the like does not come into contact with the scanner 1. The operation panel 7 can move (turn or move up and down) within a predetermined range such that the camera 7*b* can surely photograph characteristics, for example, a face of a user.

Although not explained in detail, the operation panel 7 includes a display unit configured to provide a GUI (Graphical User Interface), an input unit (a touch panel) configured to receive a control input to the display (the GUI) of the display unit, and a control circuit configured to interpret the control input received by the input unit, output a control command corresponding to a result of the interpretation, and execute operation of the display unit and the input unit.

The user can comfortably use the image forming apparatus 101 according to a GUI and an operation procedure (an operation flow) displayed on the operation panel 7.

Since the operation panel 7 is increased in size, various kinds of operation such as setting, registration, transmission of data (including a PC, a server, and the like on a network), and use of the Internet can be easily performed.

Change and correction of a GUI and a computer program can be collectively performed by only updating the control unit 5 functioning as a core.

As explaining above, among image outputs, an image output requiring authentication for a user who instructs output is guided to the inner side of the locked door and an image output that may be visually recognized by an outsider is output to the open tray in the upper part of the apparatus. Therefore, it is possible to prevent an image output from being left behind and prevent confidential information from leaking.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image forming unit which fixes a developer image on a sheet medium and outputs the sheet medium; and an output-image storing unit which stores, on an inner side of a door involving a lock mechanism, the sheet medium on which the developer image is fixed by the image forming unit, wherein when the door is unlocked and being opened, the output-image storing unit moves the sheet medium to a side of the door being opened.

2. The apparatus of claim 1, further comprising:

a stapler located in an upper side in the output-image storing unit.

3. The apparatus of claim 1, further comprising:

a saddle stapling unit located in an upper side in the image forming unit.

4. An image forming apparatus comprising:

an image forming unit which fixes a developer image on a sheet medium and outputs the sheet medium;

an output-image storing unit which holds the sheet medium fixed with the developer image, when a request is made to output the sheet medium with a finishing process by a finishing mechanism; and a lock mechanism including a door which prevents external access to the output-image storing unit, and configured to keep locking the door until authentication for allowing the door to open is performed.

5. The apparatus of claim 4, further comprising:

an authentication unit which issues a signal to unlock the output-image storing unit.

6. The apparatus of claim 5, wherein, if the door is unlocked, the output-image storing unit moves, following opening of the door, the sheet medium to a side of the opened door.

7. The apparatus of claim 4, wherein, if the door is unlocked, the output-image storing unit moves, following opening of the door, the sheet medium to a side of the opened door.

8. The apparatus of claim 7, wherein the output-image storing unit provides a space between the sheet medium and itself.

9. The apparatus of claim 8, wherein the output image storing unit includes a curved portion located near a mechanism that is configured to move the sheet medium in a sheet medium-moving direction.

10. The apparatus of claim 9, further comprising:

a scanner which creates an image data of a surface of an object to provide an output for image forming by the image forming unit.

11. The apparatus of claim 10, further comprising:

a documents conveying unit which creates other image data of an opposite surface of the object.

12. The apparatus of claim 11, further comprising:

a stapler located in an upper side in the output-image storing unit.

13. The apparatus of claim 11, further comprising:

a saddle stapling unit located in an upper side in the image forming unit.

14. The apparatus of claim 11, further comprising:

a stapler and a saddle stapling unit, each located in an upper side in the output-image storing unit.

15. The apparatus of claim 7, wherein the output-image storing unit provides a space between the sheet medium and itself.

16. The apparatus of claim 15, wherein the output-image storing unit includes a curved portion located near a mechanism that is configured to move the sheet medium in a sheet medium-moving direction.

* * * * *